US008262804B2

(12) United States Patent
Weber et al.

(10) Patent No.: US 8,262,804 B2
(45) Date of Patent: Sep. 11, 2012

(54) DISHWASHER DETERGENT FORMULATIONS COMPRISING A MIXTURE OF HYDROPHOBICALLY MODIFIED POLYCARBOXYLATES AND HYDROPHILICALLY MODIFIED POLYCARBOXYLATES

(75) Inventors: Heike Weber, Mannheim (DE); Roland Ettl, Altlussheim (DE); Juergen Tropsch, Roemerberg (DE)

(73) Assignee: BASF SE, Lugwigshafen (DE)

( * ) Notice: Subject to any disclaimer, the term of this patent is extended or adjusted under 35 U.S.C. 154(b) by 180 days.

(21) Appl. No.: 12/682,260

(22) PCT Filed: Oct. 10, 2008

(86) PCT No.: PCT/EP2008/063646

§ 371 (c)(1),
(2), (4) Date: Apr. 9, 2010

(87) PCT Pub. No.: WO2009/050123

PCT Pub. Date: Apr. 23, 2009

(65) Prior Publication Data

US 2010/0234265 A1 Sep. 16, 2010

(30) Foreign Application Priority Data

Oct. 12, 2007 (EP) ..... 07118356

(51) Int. Cl.

| | |
|---|---|
| ***B08B 3/04*** | (2006.01) |
| ***C11D 1/72*** | (2006.01) |
| ***C11D 3/33*** | (2006.01) |
| ***C11D 3/37*** | (2006.01) |
| ***C11D 3/395*** | (2006.01) |

(52) U.S. Cl. ..... 134/25.2; 134/25.3; 134/39; 134/42; 510/220; 510/223; 510/229; 510/230; 510/434; 510/475; 510/476; 510/477

(58) Field of Classification Search ..... 510/220, 510/223, 229, 230, 434, 475, 476, 477; 134/25.2, 134/25.3, 39, 42
See application file for complete search history.

(56) References Cited

U.S. PATENT DOCUMENTS

| | | | | |
|---|---|---|---|---|
| 5,039,447 | A | 8/1991 | Reuben | |
| 5,292,447 | A | 3/1994 | Venturello et al. | |
| 5,294,362 | A | 3/1994 | Venturello et al. | |
| 5,422,028 | A | 6/1995 | Oakes et al. | |
| 2007/0219110 | A1* | 9/2007 | Becker et al. | 510/392 |
| 2008/0188391 | A1 | 8/2008 | Seebeck et al. | |
| 2010/0160203 | A1* | 6/2010 | Seebeck et al. | 510/220 |

FOREIGN PATENT DOCUMENTS

| | | | |
|---|---|---|---|
| DE | 44 16 438 | | 11/1995 |
| DE | 44 43 177 | | 6/1996 |
| DE | 195 29 905 | | 2/1997 |
| DE | 195 36 082 | | 4/1997 |
| DE | 196 05 688 | | 8/1997 |
| DE | 196 13 103 | | 10/1997 |
| DE | 196 20 411 | | 10/1997 |
| DE | 196 16 693 | | 11/1997 |
| DE | 196 16 767 | | 11/1997 |
| DE | 196 16 769 | | 11/1997 |
| DE | 196 16 770 | | 11/1997 |
| DE | 196 20 267 | | 11/1997 |
| DE | 198 19 187 | | 11/1999 |
| EP | 0 272 030 | | 6/1988 |
| EP | 0 392 592 | | 10/1990 |
| EP | 0 443 651 | | 8/1991 |
| EP | 0 446 982 | | 9/1991 |
| EP | 0 453 003 | | 10/1991 |
| EP | 0 458 397 | | 11/1991 |
| EP | 0 525 239 | | 2/1993 |
| EP | 0 544 490 | | 6/1993 |
| EP | 0 544 519 | | 6/1993 |
| EP | 0 549 271 | | 6/1993 |
| EP | 0 549 272 | | 6/1993 |
| EP | 0 693 550 | | 1/1996 |
| EP | 0 778 340 | | 6/1997 |
| EP | 778340 | * | 6/1997 |
| EP | 0 851 023 | | 7/1998 |
| WO | 94 27970 | | 12/1994 |
| WO | 94 28102 | | 12/1994 |
| WO | 94 28103 | | 12/1994 |
| WO | 95 00626 | | 1/1995 |
| WO | 95 14075 | | 5/1995 |

(Continued)

*Primary Examiner* — Brian P Mruk
(74) *Attorney, Agent, or Firm* — Oblon, Spivak, McClelland, Maier & Neustadt, L.L.P.

(57) ABSTRACT

A phosphate-free detergent formulation for machine dishwashing, having from 1 to 20% by weight of a mixture of from 5 to 95% by weight of hydrophobically modified polycarboxylates I formed from 20 to 80 mol % of at least one monoethylenically unsaturated $C_3$-$C_{10}$-mono- or -dicarboxylic acid or anhydrides thereof, from 0 to 80 mol % of at least one monomer of the general formula (I)

(I)

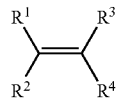

in which $R^1$, $R^2$ and $R^3$ are each independently H, $CH_3$ or $C_2H_5$, and $R^4$ is a linear, branched or cyclic radical having from 1 to 6 carbon atoms or an aromatic radical having from 6 to 12 carbon atoms, and from 0 to 20 mol % of at least one further monomer, from 5 to 95% by weight of hydrophilically modified polycarboxylates II, where the sum of a1) and a2) adds up to 100% by weight.

8 Claims, No Drawings

FOREIGN PATENT DOCUMENTS

| | | | |
|---|---|---|---|
| WO | 95 14759 | | 6/1995 |
| WO | 95 17498 | | 6/1995 |
| WO | 95 27775 | | 10/1995 |
| WO | 02 34870 | | 5/2002 |
| WO | 2005 042684 | | 5/2005 |
| WO | 2006 029806 | | 3/2006 |
| WO | WO 2006/029806 | * | 3/2006 |
| WO | 2007 025944 | | 3/2007 |
| WO | 2007 025955 | | 3/2007 |
| WO | WO 2007/025944 | * | 3/2007 |

* cited by examiner

DISHWASHER DETERGENT FORMULATIONS COMPRISING A MIXTURE OF HYDROPHOBICALLY MODIFIED POLYCARBOXYLATES AND HYDROPHILICALLY MODIFIED POLYCARBOXYLATES

The invention relates to detergent formulations for machine dishwashing.

Machine dishwashing should deliver the washed dishes in a residue-free cleaned condition with a faultlessly shiny surface. The washed dishes must be freed of food residues and the detached soil constituents must be dispersed or emulsified such that they are not redeposited on the dishware surfaces. Moreover, there should also be no occurrence of whitish spots or deposits which arise owing to the presence of lime or other inorganic and organic salts in the course of drying of water droplets or, as a result of deposition of soil constituents or inorganic salts, are precipitated as early as during the rinse operation.

Especially in modern machine dishwasher detergents, the multifunctional detergents (e.g. 3-in-1 detergents), the cleaning, rinse aid and water softening functions are combined in a single detergent formulation, such that there is no need for the consumer either to replenish salt (at water hardnesses of from 0° to 21°) or rinse aid.

In these dishwasher detergents, polymers are frequently used for scale inhibition. In phosphate-containing detergents, these may, for example, be sulfonate-containing polymers which, in particular, exhibit effects on the inhibition of calcium phosphate precipitates. The surfactants used are selected such that they are entrained into the rinse cycle and ensure optimal wetting and a good rinse outcome there. Further customarly polymers are polycarboxylates such as polyacrylic acids.

The results achieved to date can still be improved further. Especially the trend toward phosphate-free cleaning compositions, which should also still be usable without rinse aid and ion exchanger, requires new solutions. Here, the composition of the salts obtained is different than that in phosphate-containing detergents, and so different polymers exhibit the optimal action. Moreover, polymers may then, if the ion exchanger is not used, themselves precipitate as calcium salts. It is therefore necessary to use polymers which, under the rinse conditions, cannot themselves precipitate out as calcium salts but are simultaneously nevertheless capable of dispersing inorganic salts.

Many formulations on the market are phosphate-based. The phosphate used is ideal for the application, since it combines many useful properties which are required in machine dishwashing. Firstly, phosphate is capable of dispersing water hardness (i.e. insoluble salts of ions which cause water hardness, such as calcium and magnesium ions). This task is also fulfilled by virtue of the ion exchanger in the machines. However, a large proportion of products for machine dishwashing is now supplied in the form of so-called 3-in-1 formulations, in which the function of the ion exchanger is no longer necessary. In this case, the phosphate, usually combined with phosphonates, takes over the softening of the water. In addition, the phosphate disperses the detached soil and thus prevents resettling of the soil on the ware.

In the case of washing compositions, there has been a transition in many countries to entirely phosphate-free systems for ecological reasons. For the products for machine dishwashing too, there is a discussion as to whether a transition to phosphate-free products is advisable. The phosphate-free products which were still on the market in the mid-1990s, however, no longer meet current requirements on the wash outcome. The consumer now expects faultless dishware free of streaks, scale and drips, and preferably without use of additional rinse aid or regenerating salt for the ion exchanger.

EP-A 0 778 340 describes the use of copolymers of allyl alcohol ethoxylates and acrylic acid in phosphate-free dishwasher detergent compositions.

WO 2005/042684 describes the use of specific copolymers of acrylic acid, methacrylic acid and acrylic acid alkoxylates as a scale-inhibiting additive in machine dishwashing.

WO 2006/029806 describes the use of a combination of specific hydrophobically modified polycarboxylates and specific complexing agents as a builder system in dishwashing detergent formulations.

WO 02/34870 describes the combination of hydrophobically modified polycarboxylates, acrylic acid (co)polymers and phosphonates for achieving an antiscaling and an antispotting effect. Both phosphate-containing and phosphate-free dishwasher detergents are described.

It is an object of the invention to provide improved phosphate-free detergent formulations for machine dishwashing which give rise to an improved wash outcome. More particularly, it is an object of the invention to provide such formulations which, without use of additional rinse aid, give rise to dishware free of streaks, scale and drips.

The object is achieved by phosphate-free detergent formulations for machine dishwashing, comprising, as components:

a) from 1 to 20% by weight of a mixture of hydrophobically modified polycarboxylates a1) and hydrophilically modified polycarboxylates a2), composed of
   - a1) from 5 to 95% by weight of hydrophobically modified polycarboxylates I formed from
     - a11) from 20 to 80 mol % of at least one monomer from the group consisting of monoethylenically unsaturated $C_3$-$C_{10}$-mono- or -dicarboxylic acids or anhydrides thereof,
     - a12) from 0 to 80 mol % of at least one monomer of the general formula (I)

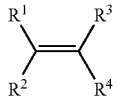

(I)

in which $R^1$, $R^2$ and $R^3$ are each independently H, $CH_3$ or $C_2H_5$, $R^4$ is a linear, branched or cyclic radical having from 1 to 6 carbon atoms or an aromatic radical having from 6 to 12 carbon atoms, and

- a13) from 0 to 20 mol % of at least one further monomer selected from the group consisting of olefins having 10 or more carbon atoms or mixtures thereof and reactive polyisobutenes having an average of from 12 to 100 carbon atoms,
   - a2) from 5 to 95% by weight of hydrophilically modified polycarboxylates II formed from
     - a21) from 50 to 99 mol % of acrylic acid and/or of a water-soluble salt of acrylic acid,
     - a22) from 0 to 50 mol % of a further acidic monomer and/or of a water-soluble salt thereof,
     - a23) from 0.1 to 20 mol % of at least one nonionic monomer of the general formula (II)

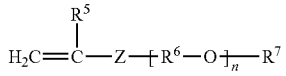

(II)

in which the variables are each defined as follows:

$R^5$ is hydrogen or methyl;

Z is —C(O)O— or —$CH_2O$—;

$R^6$ are identical or different, unbranched or branched $C_2$-$C_4$-alkylene radicals;

$R^7$ is unbranched or branched $C_1$-$C_6$-alkyl;

n is from 3 to 50, where the sum of a1) and a2) adds up to 100% by weight, b) from 0 to 50% by weight of complexing agents, c) from 0.1 to 20% by weight of low-foam nonionic surfactants, d) from 0.1 to 30% by weight of bleaches and if appropriate bleach activators, e) from 0 to 60% by weight of further builders, f) from 0 to 8% by weight of enzymes, g) from 0 to 50% by weight of one or more further additives, such as anionic or zwitterionic surfactants, bleach catalysts, alkali carriers, corrosion inhibitors, defoamers, dyes, fragrances, fillers, tablet disintegrants, organic solvents and water, where the sum of components a) to g) adds up to 100% by weight.

The formulation can be processed in the form of a tablet, powder, gel, capsule or solution. The formulations may either be those for domestic applications or for industrial application.

The object is also achieved by the use of a combination of hydrophobically modified polycarboxylates a1) and hydrophilically modified polycarboxylates a2) as cobuilders in detergent formulations for machine dishwashing.

It has been found that the use of a combination of hydrophobically modified polycarboxylates and hydrophilically modified polycarboxylates in dishwasher detergents for machine dishwashing achieves both a very good scale-inhibiting action and a very good rinse aid effect (antispotting effect).

Monomers a11) suitable for the hydrophobically modified polycarboxylates a1) are, for example, maleic acid, maleic anhydride, acrylic acid, methacrylic acid, fumaric acid, itaconic acid and citraconic acid. Preferred hydrophobically modified polycarboxylates a1) comprise, as monomers a11), monomers which are selected from the group consisting of maleic acid, maleic anhydride and acrylic acid.

Suitable monomers a12) are, for example, isobutene, diisobutene, butene, pentene, hexene and styrene. Further preferred hydrophobically modified polycarboxylates a1) comprise, as monomers a12), monomers which are selected from the group consisting of isobutene, diisobutene and styrene.

Suitable monomers a13) have at least 10, generally 10-26 carbon atoms. Suitable monomers a13) are, for example, 1-decene, 1-dodecane, 1-tetradecene, 1-hexadecene, 1-octadene, 1-eicosene, 1-docosene, 1-tetracosene and 1-hexacosene. Further preferred hydrophobically modified polycarboxylates a1) comprise, as monomers a13), monomers which are selected from the group consisting of 1-dodecene, 1-octadecene, $C_{22}$-alpha-olefin, a mixture of $C_{20}$-$C_{24}$-alpha-olefins and polyisobutene having on average from 12 to 100 carbon atoms.

Particularly preferred hydrophobically modified polycarboxylates comprise monomers a11) which are selected from maleic acid, maleic anhydride and acrylic acid, and also monomers a12) which are selected from isobutene, diisobutene and styrene, and also monomers a13) which are selected from the group consisting of 1-dodecene, 1-octadecene, $C_{22}$-alpha-olefin, a mixture of $C_{20}$-$C_{24}$-alpha-olefins and polyisobutene having on average from 12 to 100 carbon atoms. Especially preferred are copolymers formed from 30 to 70 mol % of maleic acid and maleic anhydride as monomers a11), 30 to 50 mol % of isobutene as monomers a12) and 1 to 10 mol % of octadecene as monomers a13).

The hydrophilically modified polycarboxylates II comprise, as polymerized components a21) and a22), acrylic acid, if appropriate a further acidic monomer, and/or water-soluble salts of these acids, especially the alkali metal salts such as potassium and in particular sodium salts, and ammonium salts.

The proportion of acrylic acid a21) in the hydrophilically modified polycarboxylates II is from 50 to 99 mol %, preferably from 55 to 90 mol % and more preferably from 60 to 85 mol %.

The further acidic monomer a22) is present in the hydrophilically modified polycarboxylates II to an extent of from 0 to 50 mol %, preferably to an extent of from 5 to 40 mol %, more preferably to an extent of from 10 to 35 mol % and in particular to an extent of from 15 to 30 mol %.

Acidic monomers a22) are, for example, methacrylic acid, maleic acid, monomers comprising sulfonate groups or phosphonate groups; preference is given to methacrylic acid and maleic acid.

Particularly suitable examples of the nonionic monomers a23) include: allyl alcohol, methoxypolyethylene glycol (meth)acrylate, methoxypolypropylene glycol (meth)acrylate, methoxypolybutylene glycol (meth)acrylate, methoxypoly(propylene oxide-co-ethylene oxide) (meth)acrylate, ethoxypolyethylene glycol (meth)acrylate, ethoxypolypropylene glycol (meth)acrylate, ethoxypolybutylene glycol (meth)acrylate and ethoxypoly(propylene oxide-co-ethylene oxide) (meth)acrylate, preference being given to methoxypolyethylene glycol (meth)acrylate and methoxypolypropylene glycol (meth)acrylate, and particularly preference to methoxypolyethylene glycol methacrylate.

The polyalkylene glycols comprise from 3 to 50, especially from 5 to 40 and in particular from 10 to 30 alkylene oxide units.

The proportion of the nonionic monomers a23) in the hydrophilically modified polycarboxylates II is from 0.1 to 20 mol %, preferably from 1 to 15 mol % and in particular from 2 to 10 mol %.

Preferred hydrophilically modified polycarboxylates a2) are also composed of a21) from 50 to 99 mol % of acrylic acid and/or of a water-soluble salt of acrylic acid, a22) from 0 to 50 mol % of maleic acid and/or of a water-soluble salt of maleic acid, a23) from 0.1 to 20 mol % of allyl alcohol which has been ethoxylated with from 3 to 50 mol of ethylene oxide per mole of allyl alcohol.

The ethoxylated allyl alcohol a23) is preferably alkoxylated with from 5 to 40 mol, and more preferably with from 10 to 30 mol of ethylene oxide.

The weight-average molecular weight $M_w$ of the hydrophilically modified polycarboxylates a2) is generally from 500 to 500 000 g/mol, preferably from 1000 to 300 000 g/mol and more preferably from 5000 to 100 000 g/mol.

The hydrophilically modified polycarboxylates preferably have a calcium insensitivity which corresponds to a cloud point of a solution comprising 250 mg/l of the hydrophilically modified polymer at pH 10 at a calcium concentration of >2000 mg/l of $Ca^{2+}$, i.e. cloudiness of the polymer solution as a result of precipitation of calcium salts does not occur until above this calcium concentration.

The inventive detergent formulations comprise from 1 to 20% by weight, preferably from 1 to 10% by weight, of the mixture of hydrophobically modified polycarboxylates a1) and hydrophilically modified polycarboxylates a2), where the proportion of hydrophobically modified polycarboxylates a1) is from 5 to 95% by weight, preferably from 10 to 90% by weight and more preferably from 20 to 80% by weight, and the proportion of hydrophilically modified polycarboxylates a2) is from 5 to 95% by weight, preferably from 10 to 90% and more preferably from 20 to 80% by weight, based on the sum of a1) and a2).

As component b), the inventive detergent formulations may comprise one or more complexing agents. Preferred complexing agents are selected from the group consisting of nitrilotriacetic acid, ethylenediaminetetraacetic acid, diethylenetriaminepentaacetic acid, hydroxyethylethylenediaminetriacetic acid, and methylglycinediacetic acid, glutamic acid diacetic acid, iminodisuccinic acid, hydroxyiminodisuccinic acid, ethylenediaminedisuccinic acid, aspartic acid diacetic acid, and salts thereof. Particularly preferred complexing agents b) are methylglycinediacetic acid and salts thereof.

As component c), the inventive detergent formulations comprise low-foam nonionic surfactants. These are generally present in proportions of from 0.1 to 20% by weight, preferably from 0.1 to 15% by weight and more preferably from 0.25 to 10% by weight.

Suitable nonionic surfactants comprise the surfactants of the general formula (III)

$$R^2—O—(CH_2CH_2O)_p—(CHR^1CH_2O)_m—R^3 \quad (III)$$

in which $R^2$ is a linear or branched alkyl radical having from 8 to 22 carbon atoms, $R^1$ and $R^3$ are each independently hydrogen or a linear or branched alkyl radical having 1-10 carbon atoms or H, where $R^1$ is preferably methyl, p and m are each independently from 0 to 300. Preferably, p=1-100 and m=0-30.

The surfactants of the formula (III) may be either random copolymers or block copolymers; they are preferably block copolymers.

In addition, it is possible to use di- and multiblock copolymers formed from ethylene oxide and propylene oxide, which are commercially available, for example, under the name Pluronic® (BASF Aktiengesellschaft) or Tetronic® (BASF Corporation). In addition, it is possible to use reaction products of sorbitan esters with ethylene oxide and/or propylene oxide. Likewise suitable are amine oxides or alkylglycosides. An overview of suitable nonionic surfactants is given by EP-A 851 023 and DE-A 198 19 187.

The formulations may further comprise anionic or zwitterionic surfactants, preferably in a blend with nonionic surfactants. Suitable anionic and zwitterionic surfactants are likewise specified in EP-A 851 023 and DE-A 198 19 187.

As component d), the inventive detergent formulations comprise bleaches and if appropriate bleach activators.

Bleaches are subdivided into oxygen bleaches and chlorine bleaches. Use as oxygen bleaches is found by alkali metal perborates and hydrates thereof, and also alkali metal percarbonates. Preferred bleaches in this context are sodium perborate in the form of the mono- or tetrahydrate, sodium percarbonate or the hydrates of sodium percarbonate.

Likewise useable as oxygen bleaches are persulfates and hydrogen peroxide.

Typical oxygen bleaches are also organic peracids such as perbenzoic acid, peroxyalpha-naphthoic acid, peroxylauric acid, peroxystearic acid, phthalimidoperoxycaproic acid, 1,12-diperoxydodecanedioic acid, 1,9-diperoxyazelaic acid, diperoxoisophthalic acid or 2-decyldiperoxybutane-1,4-dioic acid.

In addition, for example, the following oxygen bleaches may also find use in the detergent formulation:

cationic peroxy acids which are described in the patent applications U.S. Pat. No. 5,422,028, U.S. Pat. No. 5,294,362 and U.S. Pat. No. 5,292,447;

sulfonylperoxy acids which are described in the patent application U.S. Pat. No. 5,039,447.

Oxygen bleaches are used in amounts of generally from 0.5 to 30% by weight, preferably of from 1 to 20% by weight, more preferably of from 3 to 15% by weight, based on the overall detergent formulation.

Chlorine bleaches and the combination of chlorine bleaches with peroxidic bleaches may likewise be used. Known chlorine bleaches are, for example, 1,3-dichloro-5,5-dimethylhydantoin, N-chlorosulfamide, chloramine T, dichloramine T, chloramine B, N,N'-dichlorobenzoylurea, dichloro-p-toluenesulfonamide or trichloroethylamine. Preferred chlorine bleaches are sodium hypochlorite, calcium hypochlorite, potassium hypochlorite, magnesium hypochlorite, potassium dichloroisocyanurate or sodium dichloroisocyanurate.

Chlorine bleaches are used in amounts of generally from 0.1 to 20% by weight, preferably of from 0.2 to 10% by weight, more preferably of from 0.3 to 8% by weight, based on the overall detergent formulation.

In addition, small amounts of bleach stabilizers, for example phosphonates, borates, metaborates, metasilicates or magnesium salts, may be added.

Bleach activators are compounds which, under perhydrolysis conditions, give rise to aliphatic peroxocarboxylic acids having preferably from 1 to 10 carbon atoms, in particular from 2 to 4 carbon atoms, and/or substituted perbenzoic acid. Suitable compounds comprise one or more N- or O-acyl groups and/or optionally substituted benzoyl groups, for example substances from the class of the anhydrides, esters, imides, acylated imidazoles or oximes. Examples are tetraacetylethylenediamine (TAED), tetraacetylmethylenediamine (TAMD), tetraacetylglycoluril (TAGU), tetraacetylhexylenediamine (TAHD), N-acylimides, for example N-nonanoylsuccinimide (NOSI), acylated phenolsulfonates, for example n-nonanoyl- or isononanoyloxybenzenesulfonates (n- and iso-NOBS), pentaacetylglucose (PAG), 1,5-diacetyl-2,2-dioxohexahydro-1,3,5-triazine (DADHT) or isatoic anhydride (USA). Likewise suitable as bleach activators are nitrile quats, for example, N-methylmorpholiniumacetonitrile salts (MMA salts) or trimethylammoniumacetonitrile salts (TMAQ salts).

Preferentially suitable bleach activators are from the group consisting of polyacylated alkylenediamines, more preferably TAED, N-acylimides, more preferably NOSI, acylated phenolsulfonates, more preferably n- or iso-NOBS, MMA and TMAQ.

In addition, the following substances may find use as bleach activators in the detergent formulation:

carboxylic anhydrides such as phthalic anhydride; acylated polyhydric alcohols such as triacetin, ethylene glycol diacetate or 2,5-diacetoxy-2,5-dihydrofuran; the enol esters known from DE-A 196 16 693 and DE-A 196 16 767, and also acetylated sorbitol and mannitol and the mixtures thereof described in EP-A 525 239; acylated sugar derivatives, in particular pentaacetylglucose (PAG), pentaacetylfructose, tetraacetylxylose and octaacetyllactose, and also acetylated, optionally N-alkylated, glucamine and gluconolactone and/or N-acylated lactams, for example N-benzoylcaprolactam, which are known from the documents WO 94/27 970, WO 94/28 102, WO 94/28 103, WO 95/00 626, WO 95/14 759 and WO 95/17 498;

the hydrophilically substituted acylacetals listed in DE-A 196 16 769 and the acyllactams described in DE-A 196 16 770 and WO 95/14 075 may be used, just like the combinations, known from DE-A 44 43 177, of conventional bleach activators.

Bleach activators are used in amounts of generally from 0.1 to 10% by weight, preferably of from 1 to 9% by weight, more preferably of from 1.5 to 8% by weight, based on the overall detergent formulation.

As component e), the inventive detergent formulations may comprise further builders. It is possible to use water-soluble and water-insoluble builders, whose main task consists in binding calcium and magnesium.

The further builders used may be, for example:

low molecular weight carboxylic acids and salts thereof, such as alkali metal citrates, in particular anhydrous trisodium citrate or trisodium citrate dihydrate, alkali metal succinates, alkali metal malonates, fatty acid sulfonates, oxydisuccinate, alkyl or alkenyl disuccinates, gluconic acids, oxadiacetates, carboxymethyloxysuccinates, tartrate monosuccinate, tartrate disuccinate, tartrate monoacetate, tartrate diacetate, α-hydroxypropionic acid;

oxidized starches, oxidized polysaccharides;

homo- and copolymeric polycarboxylic acids and salts thereof, such as polyacrylic acid, polymethacrylic acid, copolymers of maleic acid and acrylic acid;

graft polymers of monoethylenically unsaturated mono- and/or dicarboxylic acids on monosaccharides, oligosaccharides, polysaccharides or polyaspartic acid; aminopolycarboxylates and polyaspartic acid;

phosphonates such as 2-phosphono-1,2,4-butanetricarboxylic acid, aminotri-(methylenephosphonic acid), 1-hydroxyethylene(1,1-diphosphonic acid), ethylenediaminetetramethylenephosphonic acid, hexamethylenediaminetetramethylenephosphonic acid or diethylenetriaminepentamethylenephosphonic acid;

silicates such as sodium disilicate and sodium metasilicate;

water-insoluble builders such as zeolites and crystalline sheet silicates.

As component f), the inventive detergent formulations may comprise enzymes. It is possible to add to the detergent between 0 and 8% by weight of enzymes, based on the overall formulation, in order to increase the performance of the detergents or to ensure the cleaning performance in the same quality under milder conditions. The enzymes used most frequently include lipases, amylases, cellulases and proteases. In addition, it is also possible, for example, to use esterases, pectinases, lactases and peroxidases.

The inventive detergents may additionally comprise, as component g), further additives such as anionic or zwitterionic surfactants, bleach catalysts, alkali carriers, corrosion inhibitors, defoamers, dyes, fragrances, fillers, tablet disintegrants, organic solvents and water.

In addition to or instead of the above-listed conventional bleach activators, it is also possible for the sulfonimines known from EP-A 446 982 and EP-A 453 003 and/or bleach-boosting transition metal salts or transition metal complexes to be present in the inventive detergent formulations as what are known as bleach catalysts.

The useful transition metal compounds include, for example, the manganese-, iron-, cobalt-, ruthenium- or molybdenum-salen complexes known from DE-A 195 29 905 and the N-analog compounds thereof known from DE-A 196 20 267, the manganese-, iron-, cobalt-, ruthenium- or molybdenum-carbonyl complexes known from DE-A 195 36 082, the manganese, iron, cobalt, ruthenium, molybdenum, titanium, vanadium and copper complexes which have nitrogen-containing tripod ligands and are described in DE-A 196 05 688, the cobalt-, iron-, copper- and ruthenium-amine complexes known from DE-A 196 20 411, the manganese, copper and cobalt complexes described in DE-A 44 16 438, the cobalt complexes described in EP-A 272 030, the manganese complexes known from EP-A 693 550, the manganese, iron, cobalt and copper complexes known from EP-A 392 592, and/or the manganese complexes described in EP-A 443 651, EP-A 458 397, EP-A 458 398, EP-A 549 271, EP-A 549 272, EP-A 544 490 and EP-A 544 519. Combinations of bleach activators and transition metal bleach catalysts are known, for example, from DE-A 196 13 103 and WO 95/27775.

Binuclear manganese complexes which comprise 1,4,7-trimethyl-1,4,7-triazacyclononane (TMTACN), for example $[(TMTACN)_2Mn^{IV}Mn^{IV}(\mu\text{-}O)_3]^{2+}(PF_6^-)_2$ are likewise suitable as effective bleach catalysts. These manganese complexes are likewise described in the aforementioned documents.

Suitable bleach catalysts are preferably bleach-boosting transition metal complexes or salts from the group consisting of the manganese salts and complexes and the cobalt salts and complexes. More preferably suitable are the cobalt(amine) complexes, the cobalt(acetate) complexes, the cobalt(carbonyl) complexes, the chlorides of cobalt or manganese, manganese sulfate or $[(TMTACN)_2Mn^{IV}Mn^{IV}(\mu\text{-}O)_3]^{2+}(PF_6^-)_2$.

Bleach catalysts may be used in amounts of from 0.0001 to 5% by weight, preferably of from 0.0025 to 1% by weight, more preferably of from 0.01 to 0.25% by weight, based on the overall detergent formulation.

As further constituents of the detergent formulation, alkali carriers may be present. Alkali carriers are ammonium and/or alkali metal hydroxides, ammonium and/or alkali metal carbonates, ammonium and/or alkali metal hydrogencarbonates, ammonium and/or alkali metal sesquicarbonates, ammonium and/or alkali metal silicates, ammonium and/or alkali metal metasilicates and mixtures of the aforementioned substances, preference being given to using ammonium and/or alkali metal carbonates, in particular sodium carbonate, sodium hydrogencarbonate or sodium sesquicarbonate.

The corrosion inhibitors used may, for example, be silver protectants from the group of the triazoles, the benzotriazoles, the bisbenzotriazoles, the aminotriazoles, the alkylaminotriazoles and the transition metal salts or complexes. Particular preference is given to using benzotriazole and/or alkylaminotriazole. In addition, active chlorine-containing agents which can distinctly reduce the corrosion of the silver surface frequently find use in detergent formulations. In chlorine-free detergents, preference is given to using oxygen- and nitrogen-containing organic redox-active compounds such as di- and trihydric phenols, for example hydroquinone, pyrocatechol, hydroxyhydroquinone, gallic acid, phloroglucinol, pyrogallol and derivatives of these compound classes. Salt- and complex-type inorganic compounds such as salts of the metals Mn, Ti, Zr, Hf, V, Co and Ce frequently also find use. Preference is given in this context to the transition metal salts which are selected from the group of the manganese and/or cobalt salts and/or complexes, more preferably from the group of the cobalt(amine) complexes, the cobalt(acetate) complexes, the cobalt(carbonyl) complexes, the chlorides of cobalt or manganese, and of manganese sulfate. It is likewise possible to use zinc compounds or bismuth compounds to prevent corrosion on the ware.

Paraffin oils and silicone oils may, if appropriate, be used as defoamers and to protect plastics and metal surfaces. Defoamers are used generally in proportions of from 0.001% by weight to 5% by weight. In addition, dyes, for example patent blue, preservatives, for example Kathon CG, perfumes and other fragrances may be added to the inventive detergent formulation.

An example of a suitable filler is sodium sulfate.

The invention is illustrated in detail by the examples which follow.

EXAMPLES

Example and comparative examples C1 to C5

To test the inventive copolymers, they were each added to a phosphate-free dishwasher detergent formulation which had the composition below.

Dishwasher Detergent Formulation 1.2% by wt. of enzyme
3% by wt. of surfactant based on fatty alcohol alkoxylates
7% by wt. of a combination of hydrophobically modified and hydrophilically modified polycarboxylate
14% by wt. of percarbonate
4% by wt. of TAED
12% by wt. of disilicate
18.8% by wt. of sodium carbonate
38% by wt. of citrate
2% by wt. of sulfate The following polymers were used:

Polymer 1: Copolymer of maleic acid and diisobutene (weight ratio 51:49) with a molecular weight of 12 000 g/mol;

Polymer 2: Copolymer of maleic anhydride, isobutene and C18-olefin (weight ratio 65:26:9), molecular weight 3000 g/mol;

Polymer 3: Polyacrylic acid, molecular weight 4000 g/mol;

Polymer 4: Copolymer of acrylic acid, maleic acid and allyl alcohol, ethoxylated with 16.6 mol of ethylene oxide per mole of allyl alcohol, in a molar ratio of 82.5:15:2.5, with a K value of 74.5 at pH 7 in 1% by weight solution at 25° C.;

Polymer 5: Copolymer of acrylic acid, methacrylic acid and methoxypolyethylene glycol methacrylate with Mw=1100 g/mol in a molar ratio of 11:4:1 with a K value of 27.2 at pH 7 in 1% by weight solution at 25° C.

In the wash tests described below, in each case 21 g of the detergent formulation were used.

In each case 50 g of ballast soil, according to SÖFW-Journal, volume 122, March 2006, p. 65, were added to the machine dishwasher at the start of the test. The test was effected under the wash conditions below.

Wash Conditions:

Dishwasher: Miele G 686 SC
Wash cycles: 2 wash cycles, 55° C., normal (without prewash)
Ware: knives (WMF Berlin table knives, monobloc) and glass tumblers (Matador, Ruhr Kristall),
Dishwasher detergent: 21 g
Soil addition 50 g of ballast soil at the start
Rinse temperature: 65° C.
Water hardness: 21° dH ($Ca:Mg:HCO^{3-}$=4:1:8)

The ware was assessed 18 h after the wash by visual grading in a lightbox which had been painted to black and had a halogen spotlight and perforated plate. The deposits on knives and glasses were rated on a scale from 10 (very good) to 1 (very poor). The highest mark of 10 corresponds to a deposit-free surface; from marks <5, deposits are discernible even under normal room lighting, and are thus regarded as objectionable.

The spotting was evaluated from 1-5 where 1=very many spots to 5=no spotting.

The test results obtained are compiled in the table below.

TABLE

Results of the wash tests

| Example | Polymer | Deposition on knives | Spotting on knives | Deposition on glasses | Spotting on glasses |
|---|---|---|---|---|---|
| C1 | 7% by wt. of polymer 2 | 5 | 5 | 4.5 | 4.5 |
| C2 | 7% by wt. of polymer 5 | 7 | 3 | 6.5 | 1.5 |
| C3 | 7% by wt. of polymer 1 | 5 | 3 | 2 | 2 |
| C4 | 7% by wt. of polymer 4 | 5.7 | 1 | 7 | 2 |
| 1 | 5% by wt. of polymer 2, 2% by wt. of polymer 5 | 6.3 | 5 | 6.0 | 4 |
| C5 | 3.5% by wt. of polymer 1, 3.5% by wt. of polymer 3 | 4.5 | 2 | 4.5 | 2 |

As can be discerned from the table, the best results are achieved with the inventive polymer combination.

The invention claimed is:

1. A phosphate-free detergent formulation for machine dishwashing, comprising, as components:

a) from 1 to 20% by weight of a mixture of hydrophobically modified polycarboxylates a1) and hydrophilically modified polycarboxylates a2), comprising
  a1) from 5 to 95% by weight of hydrophobically modified polycarboxylates I formed from
    a11) from 20 to 80 mol % of at least one monomer from the group consisting of maleic acid, maleic anhydride and acrylic acid,
    a12) from ≧0 to 80 mol % of at least one monomer selected from the group consisting of isobutene, diisobutene and styrene, and
    a13) from ≧0 to 20 mol % of at least one further monomer selected from the group consisting of 1-dodecene, 1-octadecene, $C_{22}$-alpha-olefin, a mixture of $C_{20}$-$C_{24}$-alpha-olefins and polyisobutene having an average of from 12 to 100 carbon atoms, and
  a2) from 5 to 95% by weight of hydrophilically modified polycarboxylates II formed from
    a21) from 55 to 90 mol % of acrylic acid and/or of a water-soluble salt of acrylic acid,
    a22) from 5 to 40 mol % of a further acidic monomer and/or of a water-soluble salt thereof, and
    a23) from 1 to 15 mol % of at least one nonionic monomer of the general formula (II)

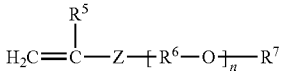

(II)

in which the variables are each defined as follows:
$R^5$ is hydrogen or methyl, Z is —C(O)O;

$R^6$ are identical or different, unbranched or branched $C_2$-$C_4$-alkylene radicals;

$R^7$ is unbranched or branched $C_1$-$C_6$-alkyl;

n is from 3 to 50, where the sum of a1) and a2) adds up to 100% by weight, b) from 0 to 50% by weight of complexing agents, c) from 0.1 to 20% by weight of low-foam nonionic surfactants, d) from 0.1 to 30% by weight of bleaches and optionally bleach activators, e) from 0 to 60% by weight of further builders, f) from 0 to 8% by weight of enzymes, and g) from 0 to 50% by weight of one or more further additives, selected from anionic or zwitterionic surfactants, bleach catalysts, alkali carriers, corrosion inhibitors, defoamers, dyes, fragrances, fillers, organic solvents and water, where the sum of components a) to g) adds up to 100% by weight.

2. The phosphate-free detergent formulation according to claim 1, wherein the hydrophilically modified polycarboxylates have a calcium insensitivity corresponding to a cloud point of a solution comprising 250 mg/l of the hydrophilically modified polymer at pH 10 at a calcium concentration of >2000 mg/l of $Ca^{2+}$.

3. The phosphate-free detergent formulation according to claim 1, wherein the hydrophilically modified polycarboxylates have a calcium insensitivity corresponding to a cloud point of a solution comprising 250 mg/l of the hydrophilically modified polymer at pH 10 at a calcium concentration of >2000 mg/l of $Ca^{2+}$.

4. The phosphate-free detergent formulation according to claim 1, wherein complexing agent b) is selected from the group consisting of nitrilotriacetic acid, hydroxyethylenediaminetriacetic acid, ethylenediaminetetraacetic acid, di-ethylenetriaminepentaacetic acid and methylglycinediacetic acid, glutamic acid diacetic acid, iminodisuccinic acid, hydroxyiminodisuccinic acid, glutamic acid diacetic acid, iminodisuccinic acid, hydroxyiminodisuccinic acid, ethylenediaminedisuccinic acid, aspartic acid diacetic acid, and salts thereof.

5. The phosphate-free detergent formulation according to claim 1, wherein the complexing agent b) is selected from the group consisting of nitrilotriacetic acid, hydroxyethylethylenediaminetriacetic acid, ethylenediaminetetraacetic acid, di-ethylenetriaminepentaacetic acid and methylglycinediacetic acid, glutamic acid diacetic acid, iminodisuccinic acid, hydroxyiminodisuccinic acid, ethylenediaminedisuccinic acid, aspartic acid diacetic acid, and salts thereof.

6. The phosphate-free detergent formulation according to claim 2, wherein the complexing agent b) is selected from the group consisting of nitrilotriacetic acid, hydroxyethylethylenediaminetriacetic acid, ethylenediaminetetraacetic acid, di-ethylenetriaminepentaacetic acid and methylglycinediacetic acid, glutamic acid diacetic acid, iminodisuccinic acid, hydroxyiminodisuccinic acid, ethylenediaminedisuccinic acid, aspartic acid diacetic acid, and salts thereof.

7. A method of dishwashing comprising washing a dish in the presence of the phosphate-free detergent formulation of claim 1.

8. The phosphate-free detergent formulation according to claim 1, comprising component a21) in an amount of from 60 to 85 mol %, component a22) in an amount of from 10 to 35 mol % of a further acidic monomer and/or of a water-soluble salt thereof, and component a23) in an amount of from 2 to 10 mol %.

* * * * *